US005154347A

United States Patent [19]

Vijay

[11] Patent Number: 5,154,347

[45] Date of Patent: Oct. 13, 1992

[54] ULTRASONICALLY GENERATED CAVITATING OR INTERRUPTED JET

[75] Inventor: Mohan M. Vijay, Gloucester, Canada

[73] Assignee: National Research Council Canada, Ottawa, Canada

[21] Appl. No.: 672,217

[22] Filed: Mar. 20, 1991

[30] Foreign Application Priority Data

Feb. 5, 1991 [CA] Canada ..... 2035702

[51] Int. Cl.[5] ..... B05B 17/06

[52] U.S. Cl. ..... 239/4; 239/102.2

[58] Field of Search ..... 239/4, 102.1, 102.2, 239/590, 590.5; 83/53, 177; 366/127; 68/3 SS; 310/323, 325

[56] References Cited

U.S. PATENT DOCUMENTS

| | | | |
|---|---|---|---|
| 3,368,085 | 2/1968 | McMaster et al. | 310/325 |
| 3,373,752 | 3/1968 | Inoue | 239/4 |
| 3,528,704 | 9/1970 | Johnson, Jr. | 239/499 X |
| 3,713,699 | 1/1973 | Johnson, Jr. | 239/424 X |
| 3,807,632 | 4/1974 | Johnson, Jr. | 239/104 |
| 4,262,757 | 4/1981 | Johnson, Jr. | 239/101 X |
| 4,474,251 | 10/1984 | Johnson, Jr. | 239/101 X |
| 4,787,465 | 11/1988 | Dickinson et al. | 239/424 X |
| 4,850,440 | 7/1989 | Smet | 175/67 |
| 4,852,668 | 8/1989 | Dickinson et al. | 175/67 |

FOREIGN PATENT DOCUMENTS 1462371 1/1977 United Kingdom .

OTHER PUBLICATIONS

Ashley's Study of an Ultrasonically Generated Cavitating or Interrupted Jet: Aspects of Design, M.M.V.J., Paper B2, Jet Cutting Technology, Jun. 26-28, 1984.

*Primary Examiner*—Andres Kashnikow
*Assistant Examiner*—Lesley D. Morris
*Attorney, Agent, or Firm*—Sughrue, Mion, Zinn, Macpeak and Seas

[57] ABSTRACT

There is described an improved ultrasonic nozzle including a nozzle body having a fluid flow channel formed axially therethrough with an inlet at an upstream end of the channel for receiving a pressurized fluid and an orifice at the downstream end of the body for discharging the pressurized fluid towards a surface to be eroded, a transformer axially aligned within the flow channel to form, in cooperation with the flow channel, an annulus between the two for the flow of the pressurized fluid, a vibrator for ultrasonically oscillating the transformer to pulse the pressurized fluid prior to its discharge through the orifice. The flow channel and transformer taper conformably axially inwardly in the direction of flow of the pressurized fluid at a uniform rate so that the transverse width of the annulus remains constant along the length of the transformer.

34 Claims, 5 Drawing Sheets

P = PROFILE V = VELOCITY S = STRESS

ULTRASONICALLY GENERATED CAVITATING OR INTERRUPTED JET

FIELD OF THE INVENTION

The present invention relates to a method and apparatus for enhancing the erosive capabilities of a high velocity liquid jet when directed against a surface to be eroded, and more particularly to an improved nozzle using ultrasonic energy to generate cavitation or pulsation in a high speed continuous water jet or to generate a plurality of converging discontinuous liquid jets.

BACKGROUND OF THE INVENTION

In the cutting of hard material, including rock, there has been considerable effort directed to the development of economic alternatives to drilling by means of coring and grinding bits. Much research has occurred with respect to the use of high pressure fluid jets. Although continuous high pressure, high velocity jets can themselves be used for erosive purposes, the specific drilling energy of such techniques is considerably higher than the specific energy required for grinding or coring techniques, thereby reducing economic competitiveness.

This has led to the search for variations in fluid jet technology directed towards the amplification of impact and resulting erosive enhancement at the target surface. Variations that have been investigated include pulsed, percussive or interrupted, cavitating and abrasive jets. The present invention concerns enhanced erosion using cavitating and pulsed jets, and an improved nozzle for generating these kinds of erosive streams.

The attraction of frequently repeated water hammer pressure effects by means of a pulsed jet has focused considerable attention on this particular method. A percussive jet can be obtained by means of a rotor modulating a continuous stream of water at a predetermined frequency. More practically, the oscillations in the flow will be self-resonating and self-sustaining, created either by tandem orifices with a resonating chamber in between, or by means of standing waves in the pipe leading to the nozzle. It can be demonstrated that erosive intensity is considerably enhanced using percussive jets as compared to unmodulated continuous jets.

Enhanced efficiency is also obtained by means of the use of cavitating jets, that is, jets in which cavitation bubbles are induced either by means of a centre body in the nozzle, by turning vanes inducing vortex cavitation, or by directing the jet past sharp corners within the nozzle orifice causing pressure differentials across that orifice. As used herein, cavitation means the rapid formation and collapse of vapour pockets in areas of low fluid pressure.

Existing methods for the generation of cavitating jets are generally based on the hydrodynamic principles of the jet issuing from nozzles under submerged conditions. Importantly as well, existing nozzles produce either cavitating or pulsed jets and further provide no means to control bubble or slug population, or to focus the vibratory energy used to induce cavitation.

Cavitation in low speed liquid flows is generated either by means of a venturi system (for example, sharp corners in the orifice past which the liquid will flow) or by vibratory methods. Experimental results indicate that the vibratory method is more effective in causing erosive damage by a factor of up to $10^3$. Vibrations in a liquid jet stream generated by an ultrasonic transducer cause alternating pressures which assume a sinusoidal pattern. Photographic studies have revealed that an ultrasonic field in water generates cavitation bubble clouds. Alternatively, sinusoidal modulation of the fluid velocity at the nozzle exit can cause bunching and interruption of the jet.

Accordingly, in a single system incorporating an ultrasonic transducer, it is possible to produce either high density cavitation bubble clouds, or pulsed slugs in a high velocity fluid jet. This in turn permits control of the bubble or slug population by varying the frequency and amplitude of the ultrasonic vibrations, rather than by means of less efficient adjustments to ambient pressure or fluid velocity.

The erosive characteristics and capabilities of cavitating and interrupted jets are well known and have been studied both theoretically and experimentally as have the hydrodynamics thereof. The inclusion herein of a detailed mathematical analysis of these phenomena may therefore be omitted. The emphasis herein will therefore be on the hydrodynamic conditions in a nozzle required for the improved growth of cavitation bubbles or for interrupting the jet to form high velocity slugs of water.

SUMMARY OF THE INVENTION

It is an object of the present invention to provide an improved ultrasonic nozzle obviating and mitigating from the disadvantages of the prior art.

It is a further object of the present invention to provide an ultrasonic nozzle adjustable to produce either cavitating or pulsed jets for erosive purposes.

According to the present invention, then, there is provided an ultrasonic nozzle comprising a nozzle body having a fluid flow channel formed axially therethrough with an inlet at an upstream end thereof for receiving a pressurized fluid and an orifice at a downstream end thereof for discharging said pressurized fluid towards a surface to be eroded, transformer means axially aligned within said flow channel to form in cooperation with said flow channel an annulus therebetween for the flow of said pressurized fluid, vibratory means for ultrasonically oscillating said transformer means to pulse said pressurized fluid prior to the discharge thereof through said orifice, wherein said flow channel and said transformer means taper conformably axially inwardly in the direction of flow of said pressurized fluid at a uniform rate such that the transverse width of said annulus remains constant along the length of said transformer means.

According to a further aspect of the present invention, there is also provided a method of eroding the surface of a solid material with a high velocity jet of fluid comprising the steps of directing pressurized fluid through an annulus in a nozzle formed between a fluid flow channel in said nozzle and an ultrasonic transformer axially aligned within said channel, discharging said fluid through an orifice at a downstream end of said fluid flow channel in a stream comprising an outer annular sheath of high velocity fluid surrounding a zone of lower pressure turbulent flow fluid, oscillating said transformer at an ultrasonic frequency to pulse said lower pressure fluid axially downstream of said transformer prior to the discharge thereof through said orifice, and focusing the energy of said transformer immediately downstream thereof in said zone of lower pressure turbulent flow to increase the erosive power of said fluid discharged through said orifice.

BRIEF DESCRIPTION OF THE DRAWINGS

Preferred embodiments of the present invention will now be described in greater detail and will be better understood when read in conjunction with the following drawings, in which.

DETAILED DESCRIPTION

Figure 1:
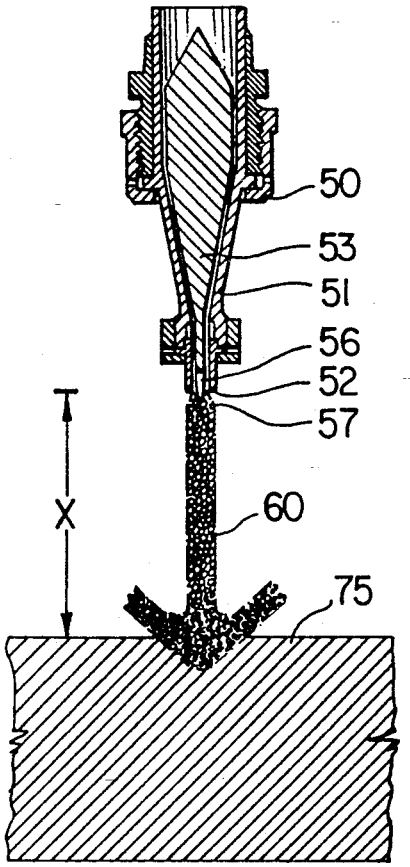
FIG. 1 (PRIOR ART)
FIG. 1 is a cross-sectional view of a typical conventional non-vibratory nozzle for generating cavitation bubbles.

With reference to FIG. 1, there is shown a non-vibratory nozzle of known configuration for generating cavitation bubbles in a high speed liquid jet. The nozzle consists of an outer body 50 including a velocity increasing constriction 51 opening outwardly through an orifice 52. A centre body 53 is placed in the flow path of the fluid stream so that its downstream end 56 is located immediately adjacent orifice 52. Cavitation bubbles 60 are most likely generated in the low pressure area 57 immediately downstream of end 56. Placing target surface 75 at the correct distance x from the point where the cavitation bubbles are generated is important so that the bubbles collapse substantially simultaneously with their impingement onto the surface for maximum amplification of the stream's erosive effect when compared to the cutting action of an unmodulated jet without cavitation or pulsating slugs.

Conventional nozzles of this general configuration provide satisfactory results, but provide no means to control frequency or intensity of cavitation or pulsation. Nor are such nozzles readily adaptable to provide a single system allowing the generation of either cavitation or pulsation with only small variations in nozzle geometry. Moreover, as mentioned above, cavitation induced by non-vibratory techniques has been found less effective in eroding hard material compared to cavitation induced by vibratory methods.

Figure 2:
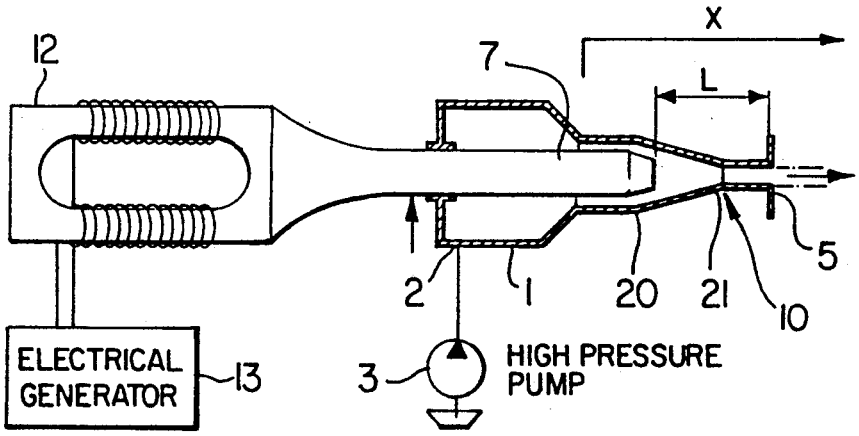
FIG. 2 is a schematical cross-sectional representation of an ultrasonic nozzle.

With reference now to FIG. 2, a vibratory ultrasonic nozzle consists of a nozzle body 1 having an inlet 2 for pressurized water from high pressure pump 3, an orifice 5 through which the high velocity fluid jet discharges towards the surface to be eroded, and a centre body or transformer 7 disposed along the longitudinal axis of the nozzle. Transformer 7 is oscillated by means of an ultrasonic vibrator such as a piezoelectric or magnetostrictive transducer 12 and its associated signal generator and amplifier 13.

To induce cavitation or interruption in the jet discharging from the nozzle, the objective is to produce high intensity sonic fields in the region between constrictions 20 and 21 by causing transformer 7 to vibrate inside the nozzle. This can be accomplished by properly designing the transformer to focus the ultrasonic energy from transducer 12, as will be described below.

Velocity of flow in the nozzle depends on the shape of the nozzle, the size of the orifice 5 and pressure from pump 3. Ambient pressure $P_0$ between constriction 20 and orifice 5 changes due to hydraulic friction and velocity of the flow. For some nozzle designs, a uniform velocity of flow can be assumed, therefore the ambient pressure between constriction 20 and orifice 5 is a function of the length of coordinate x and friction within the nozzle. To produce cavitation, the acoustic pressure $P_a$ generated by transformer 7 should be at least 1.1 and up to 6 times higher than the ambient pressure $P_0$.

Whether the ultrasonic nozzle will produce high speed slugs or cavitation bubbles will depend largely upon nozzle geometry, the shape and placement of the transformer relative to the nozzle orifice and the power and frequency of the ultrasonic waves induced by the transformer.

Figure 3:
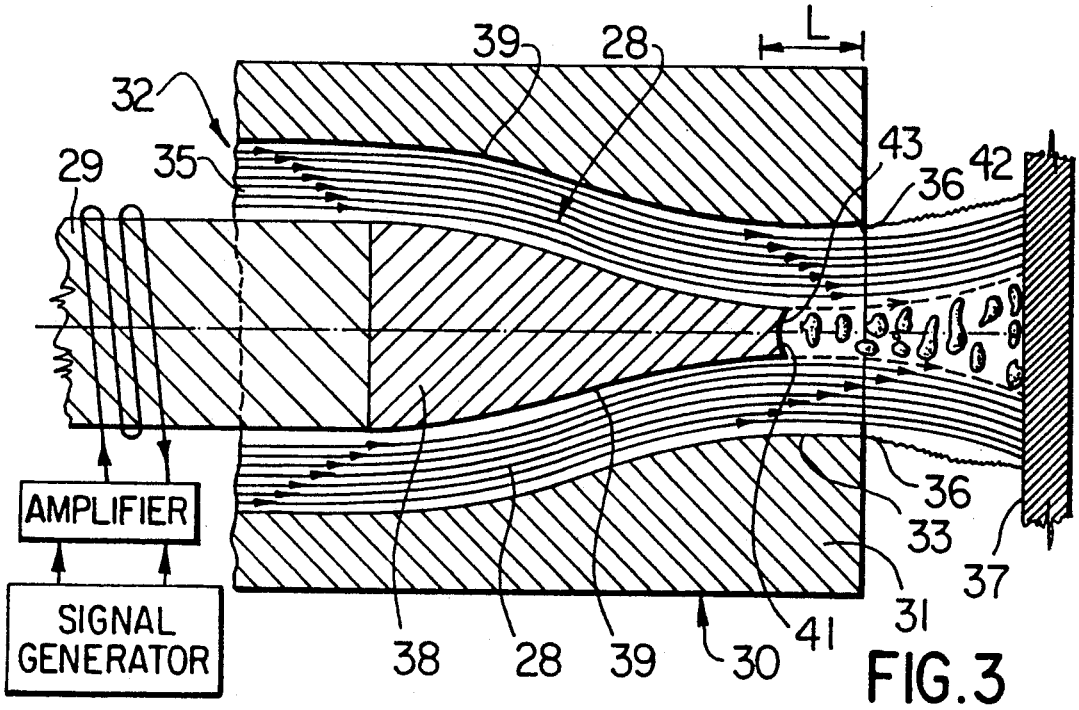
FIG. 3 is a cross-sectional view of an ultrasonic nozzle in accordance with the present invention.
Figure 4:
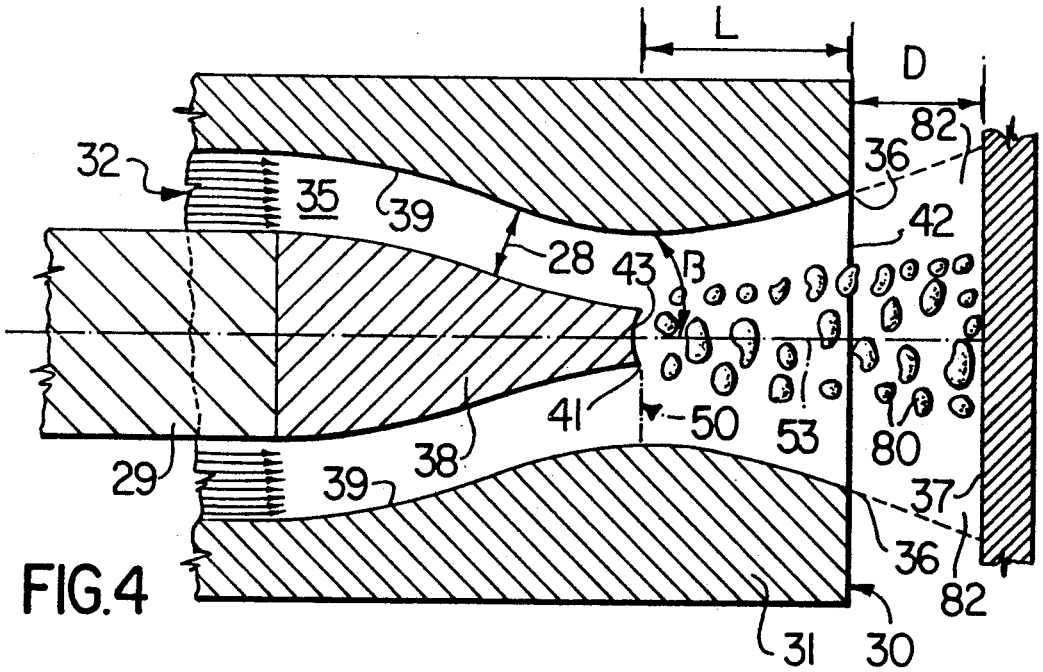
FIG. 4 is a cross-sectional view of a modification of the nozzle of FIG. 3 for generating cavitation bubbles.

Reference will now be made to FIGS. 3 and 4 showing applicant's novel nozzles for producing, in the case of the nozzle of FIG. 3, predominantly high speed water slugs, and cavitation bubbles in the case of the nozzle shown in FIG. 4.

With reference to FIG. 3, there is shown a converging nozzle 30 for generating predominantly slugs in high speed water jets.

Nozzle 30 consists of a nozzle body 31 having a flow channel 32 formed therethrough. As will be described below, the shape of channel 32 may vary in the longitudinal direction of flow, but transversely, the channel is typically circular or near-circular in shape along its entire length. Pressurized fluid 35 (usually water) pumped through the nozzle will discharge through orifice 36 against the surface 37 of a material to be eroded. Axially aligned within channel 32 is a transformer 38 connected at its upstream end to an ultrasonic vibrator 29 such as a piezoelectric or magnetostriction transducer.

Figure 6:
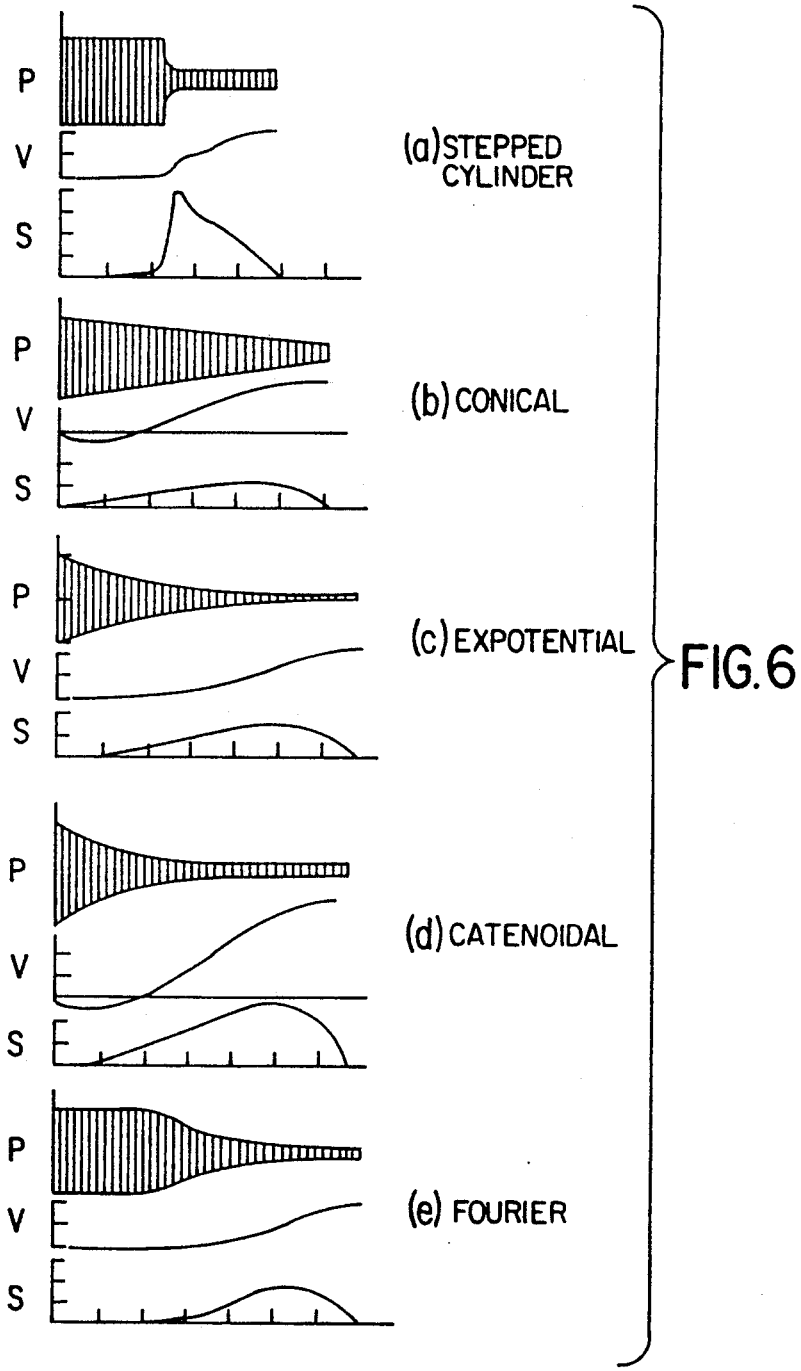
FIG. 6 illustrates a variety of possible profiles for ultrasonic transformers used in the nozzles of FIGS. 3, 4 and 5.

The longitudinal cross-sectional profile of transformer 38 may take different shapes, examples of which are shown in FIG. 6. Acceptable profiles include stepped down cylinders, simple frusto-cones or exponential, catenoidal or Fourier curves all as shown in FIG. 6. The preferred profile of the transformer is exponential or catenoidal.

The equation of the exponential profile is determined by the formula:

$$R = R_0 e^{-kx}$$

where

R = radius of the profile at any distance x from the root $R_0$ = radius of the profile at the root $R_t$ = radius of the profile at the tip L = length of the transformer k = constant = $\ln (R_0/R_t)/L$ The equation for the catenoidal profile is:

$$R = R_0 \cosh_2 b(L-x)$$

where b = arc cosh $(R_0 Rt)/2L$

The equation for the Fourier profile consists of a series of sine or cosine functions.

To minimize hydraulic losses so that maximum jet velocity is maintained, the axial cross-sectional shape of channel 32 is chosen to conform to the longitudinal profile of transformer 38 as shown in FIG. 3. Thus, the width of the annulus 28 between transformer 38 and peripheral wall 39 of channel 32 remains constant along the length of the transformer to its downstream end 41.

Figure 7:
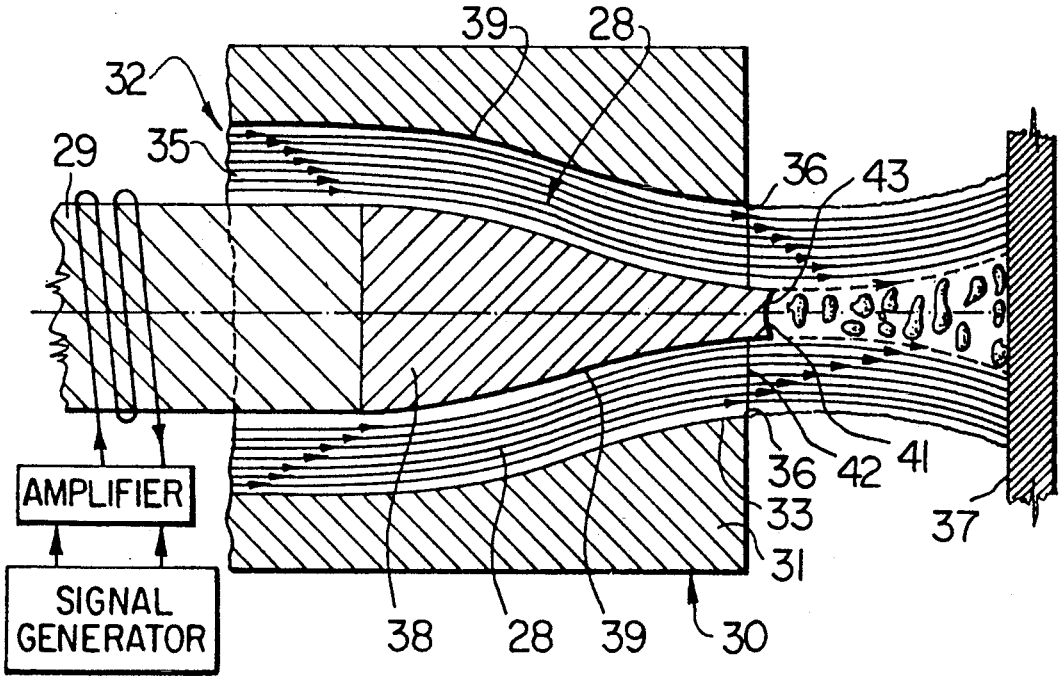
FIG. 7 is a cross-sectional view of the ultrasonic nozzle of FIG. 3 with the downstream end of the transformer positioned downstream of the nozzle orifice.

Orifice 36 is essentially cylindrical in longitudinal cross-sectional shape and in one embodiment constructed by the applicant in which the total liquid flow from the pump is 76 liters per minute, its diameter can vary depending on the operating pressure, from 1.96 mm (at 138 MPa) to 4.16 mm (at 6.9 MPa). The diameter of orifice 36 will henceforth be referred to as the nozzle diameter in relation to the embodiment of FIG. 3. The nozzle as shown produces predominantly slugs of water due to its design wherein the converging section of the nozzle terminates in a substantially cylindrical portion 33 with parallel side walls. In this environment, cavitation bubbles will have insufficient time to grow, particularly as tip 41 of transformer 38 can be adjusted to be located just downstream as shown in FIG. 7 or slightly upstream from the exit plane 42 of orifice 36. The distance L between tip 41 and exit plane 42 of orifice 36 may vary in the range between 5 nozzle diameters upstream and 1 nozzle diameter downstream of said exit plane (e.g., 20.8 mm upstream to 1.96 mm downstream of said exit plane, depending upon the operating pressure and orifice diameter chosen).

It has been found that slug population is substantially enhanced if the ultrasonic energy of transformer 38 is focused substantially at a point, and this is effectively accomplished by forming tip 41 with a concavity 43. Concavity 43 may be hemi-spherical in shape or may define a less severe arc, the curvature of which is a function of the arc's radius. Concavity 43 greatly increases the power density within the nozzle immediately downstream of the transformer to yield ultra high speed pulses or slugs of water. The rate at which the pulses are formed and their size can be controlled by respectively varying the frequency and amplitude of the ultrasonic vibrations generated by the transformer.

In one embodiment constructed by the applicant, nozzle 30 is fabricated or otherwise made of from 17–4 Ph stainless steel having a Rockwell hardness of 45 (C scale). Vibrator 29 is driven by a 1 kw transducer operable at a frequency between 0 and 10 kHz. Fluid discharge velocity at orifice 36 is variable to a maximum of approximately 1500 feet per second.

With reference to FIG. 4, there is shown a variation of the present nozzle including an adaptation designed to promote cavitation within the nozzle. In FIG. 4, like reference numerals have been used to identify like elements to those appearing in FIG. 3.

As with the nozzle of FIG. 3, the profile of the transformer and the flow channel conform to one another proceeding in the direction of flow to the end of transformer 38 at tip 41. At that point, the nozzle forms a substantially cylindrical constricted throat 50 and begins to diverge until exiting at orifice 36. The rate of divergence measured as an angle $\beta$ between longitudinal axis 53 and peripheral wall 39 varies between 2° and 10°.

The upstream distance L between tip 41 and exit plane 42 of the orifice 36 will vary between 5 to 50 throat diameters (+9.8 mm to 104 mm, depending on the operating pressure and the throat diameter chosen) depending upon the desired bubble intensity. The diameter of throat 50 in one embodiment constructed by the applicant in which the total liquid flow from the pump is 76 liters/min., can vary, depending on the operating pressure, from 1.96 mm (at 138 MPa) to 4.16 mm (at 6.9 MPa). The distance D between the orifice and the surface to be eroded or cut will typically fall in the range from 2.5 mm to 200 mm, the latter being the distance from orifice 36 beyond which cavitating jets will be generally ineffective.

The diameter of orifice 36 will vary as a function of the angle $\beta$ and the distance L. For example, when $\delta=2°$ and $L=5$ throat diameters (9.8 mm), the diameter of orifice 36 will equal 2.64 mm. Similarly, if $\beta=10°$ and $L=50$ throat diameters, the orifice diameter at the exit plane thereof will be 77.5 mm.

Transformer 38 is located such that the energy in the ultrasonic waves generated thereby is focused by means of the concavity 43 adjacent throat 50 of the nozzle, this being a zone of minimum pressure within the nozzle and therefore the environment most conducive to formation of the bubbles. Bubble population and bubble size can be controlled by varying the frequency (0 to 10 kHz) and amplitude (to a maximum of ½ mm) of the ultrasonic waves produced by the transformer, and adjustments to the distance L. Bubble population will in turn control erosive intensity.

It is known that cavitating jets are far more effective when discharged under submerged conditions rather than in air. In the present nozzle, the cavitation bubbles 80 are completely surrounded by an annular stream of water 82 which emulates a submerged discharge. The nozzle will therefore operate effectively whether used in ambient atmospheric or under submerged conditions.

To provide a suitable magnification of the displacement amplitude between the ultrasonic transducer and the vibrating transformer-water contact interface, solid metallic transformers are used. The transformers should provide a suitable impedance matched between the transducer and the load to which it is to be coupled. Maximum output of the transformer is limited by the fatigue strength of the metal (stainless steel, nickel or nickel alloy) used to make the same. As will be seen from the accompanying stress plots in FIG. 6, the curved transformers produce the desired modulations with much lower stress as compared to the stepped or simple conical transformers.

Figure 5:
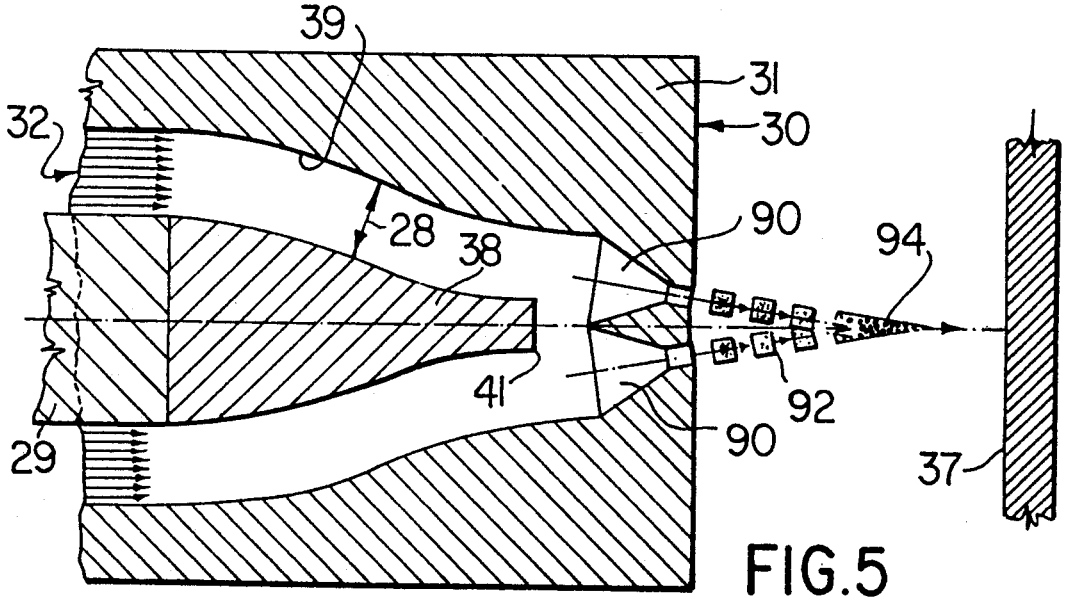
FIG. 5 is a cross-sectional view of a further modification of the nozzle of FIG. 3 to produce converting slugs to generate ultra high speed water slugs.

A further modification to the present nozzle will now be described with reference to FIG. 5. Briefly, when two slugs of water converge to a point, each having a velocity of $V_0$, a faster, augmented jet having a velocity $V_{fj}$ is formed, followed by a slower jet. The augmentation factor equals $V_{fj}/V_0$ and depends upon, amongst other factors, the shape of the converging slugs and the angle of convergence of the streams. In some instances, velocity augmentation by a factor of 10 can be achieved to greatly intensify the erosive effect. More typically, augmentation factors vary in the range of 3 to 10.

To achieve augmentation, a pair of converging nozzles 90 are formed to cause slugs 92 travelling at velocity $V_0$ to collide resulting in fast jet 94 having a velocity $V_{fj}$. The angle of convergence between the two streams may vary in the range of 10° to 60°. In other respects, the nozzle of FIG. 5 is substantially the same as the nozzles of FIGS. 3 and 4 with the exception that no concavity need be formed at the tip of the transformer as it is obviously unnecessary to focus the transformer's ultrasonic energy for fluid discharge in axial alignment therewith.

The embodiments of the invention in which an exclusive property of privilege is claimed are defined as follows:

1. An ultrasonic nozzle comprising:

a nozzle body having a fluid flow channel formed axially therethrough with an inlet at an upstream end thereof for receiving a pressurized fluid and an orifice at a downstream end thereof for discharging said pressurized fluid towards a surface to be eroded;

transformer means axially aligned within said flow channel to form in cooperation with said flow channel an annulus therebetween for the flow of said pressurized fluid;

vibratory means for ultrasonically oscillating said transformer means to pulse said pressurized fluid prior to the discharge thereof through said orifice, the downstream end of said transformer means including a concavity formed therein for focusing the energy of said ultrasonic vibrations downstream of said transformer means;

wherein said flow channel and said transformer means taper conformably axially inwardly in the direction of flow of said pressurized fluid at a uniform rate such that the transverse width of said annulus remains constant along the length of said transformer means.

2. The nozzle of claim 1 wherein said downstream end of said transformer means is positioned at one of a predetermined distance upstream of said orifice and a predetermined distance downstream from said orifice.

3. The nozzle of claim 2 wherein said flow channel between said downstream end of said transformer means and said orifice is cylindrical in transverse cross-sectional shape.

4. The nozzle of claim 3 wherein said downstream end of said transformer means is located within the range of 5 nozzle diameters upstream to 1 nozzle diameter downstream from the exit plane of said orifice for stimulating the discharge of slugs of fluid through said orifice.

5. The nozzle of claim 2 further including means for varying the frequency and amplitude of said ultrasonic vibrations generated in said transformer means.

6. The nozzle of claim 2 wherein the longitudinal cross-sectional profile of said transformer means is frusto-conical.

7. The nozzle of claim 2 wherein the longitudinal cross-sectional profile of said transformer means defines converging exponential curves.

8. The nozzle of claim 2 wherein the longitudinal cross-sectional profile of said transformer means defines converging catenoidal curves.

9. The nozzle of claim 2 wherein the longitudinal cross-sectional profile of said transformer means defines converging Fourier curves.

10. The nozzle of claim 2 wherein said flow channel includes a constricted throat located adjacent said downstream end of said transformer means.

11. The nozzle of claim 10 wherein said flow channel between said throat and said orifice widens axially outwardly such that the diameter of said orifice exceeds the diameter of said throat.

12. The nozzle of claim 11 wherein said downstream end of said transformer means is located within the range of 5 to 50 throat diameters upstream from the exit plane of said orifice to facilitate cavitation in said pressurized fluid downstream of said transformer means.

13. The nozzle of claim 12 wherein the rate of widening of said flow channel increases in the direction from said throat to said orifice.

14. The nozzle of claim 13 wherein said rate of widening measured as an angle between the longitudinal axis of said nozzle and the surface of said flow channel varies from 2° at said throat to 10° at said orifice.

15. An ultrasonic nozzle for generating a fluid jet having enhanced erosive capability, comprising:

a nozzle body having a fluid flow channel formed axially therethrough with an inlet at an upstream end thereof for receiving a pressurized fluid and an orifice at a downstream end thereof for discharging said pressurized fluid towards a surface to be eroded, said orifice comprising at least two nozzles for directing said pressurized fluid flowing therethrough towards one another in a converging stream whereby the velocity of the fluid following convergence exceeds the velocity of said fluid prior to convergence;

transformer means axially aligned within said flow channel to form in cooperation with said flow channel an annulus therebetween for the flow of said pressurized fluid; and vibratory means for ultrasonically oscillating said transformer means to pulse said pressurized fluid prior to the discharge thereof through said orifice;

wherein said flow channel and said transformer means taper conformably axially inwardly in the direction of flow of said pressurized fluid.

16. The nozzle of claim 15 wherein said transformer means includes a downstream end thereof positioned a predetermined distance upstream from said orifice.

17. The nozzle of claim 16 wherein said flow channel between said downstream end of said transformer means and said orifice is cylindrical in transverse cross-sectional shape.

18. The nozzle of claim 16 further including means for varying the frequency and amplitude of said ultrasonic vibrations generated in said transformer means.

19. The nozzle of claim 18 wherein the longitudinal cross-sectional profile of said transformer means is frusto-conical.

20. The nozzle of claim 18 wherein the longitudinal cross-sectional profile of said transformer means defines converging exponential curves.

21. The nozzle of claim 18 wherein the longitudinal cross-sectional profile of said transformer means defines converging catenoidal curves.

22. The nozzle of claim 18 wherein the longitudinal cross-sectional profile of said transformer means defines converging Fourier curves.

23. The nozzle of claim 15 wherein the angle of conversions of said fluid from said two nozzles is within the range of 10° to 60°.

24. A method of eroding the surface of a solid material with a high velocity jet of fluid comprising the steps of:

directing pressurized fluid through an annulus in a nozzle formed between a fluid flow channel in said nozzle and an ultrasonic transformer axially aligned within said channel;

discharging said fluid through an orifice at a downstream end of said fluid flow channel in a stream comprising an outer annular jet of high velocity laminar flow fluid surrounding a zone of lower pressure turbulent flow fluid;

oscillating said transformer at an ultrasonic frequency to pulse said lower pressure fluid axially downstream of said transformer prior to the discharge thereof through said orifice;

focusing the energy of said transformer immediately downstream thereof in said zone of lower pressure turbulent flow to increase the erosive power of said fluid discharged through said orifice.

25. The method of claim 24 wherein the erosive power of said fluid is increased by the enhanced formation of pulsed slugs of water due to said focusing of the energy of said transformer.

26. The method of claim 24 wherein the erosive power of said fluid is increased by enhanced promotion of cavitation within said turbulent flow arising from said focusing of the energy of said transformer.

27. The nozzle of claim 2 wherein the longitudinal cross-sectional profile of said transformer means is that of a stepped cylinder.

28. The nozzle of claim 18 wherein the longitudinal cross-sectional profile of said transformer means is that of a stepped cylinder.

29. An ultrasonic nozzle for generation of a high speed fluid jet having enhanced erosive capability, comprising:

a nozzle body having a fluid flow channel formed axially therethrough with an inlet at an upstream end thereof for receiving a pressurized fluid and an orifice at a downstream end thereof for discharging said pressurized fluid towards a surface to be eroded;

transformer means axially aligned within said flow channel to form in cooperation with said flow channel an annulus therebetween for the flow of said pressurized fluid; and vibratory means for ultrasonically oscillating said transformer means to pulse said pressurized fluid prior to the discharge thereof through said orifice;

wherein said flow channel and said transformer means taper conformably axially inwardly in the direction of flow of said pressurized fluid at a uniform rate such that the transverse width of said annulus remains constant along the length of said transformer means.

30. The nozzle of claim 29 wherein the downstream end of said transformer means includes a concavity formed therein for focusing the energy of said ultrasonic vibrations downstream of said transformer means.

31. The nozzle of claim 30 wherein said flow channel includes a constricted throat located adjacent said downstream end of said transformer means.

32. The nozzle of claim 31 wherein said flow channel between said throat and said orifice widens axially outwardly, said rate of widening measured as an angle between the longitudinal axis of said nozzle and the surface of said flow channel varying from 2° at said throat to 10° at said orifice.

33. The nozzle of claim 15 wherein the transverse width of said annulus remains constant along the length of said transformer means.

34. The method of claim 24 wherein said energy of said transformer is focused by means of a concavity formed in a downstream end of said ultrasonic transformer.

* * * * *